US005464000A

United States Patent [19]

Pursifull et al.

[11] Patent Number: 5,464,000

[45] Date of Patent: Nov. 7, 1995

[54] FUEL CONTROLLER WITH AN ADAPTIVE ADDER

[75] Inventors: Ross D. Pursifull, Dearborn; Allan J. Kotwicki, Sterling Heights, both of Mich.

[73] Assignee: Ford Motor Company, Dearborn, Mich.

[21] Appl. No.: 132,419

[22] Filed: Oct. 6, 1993

[51] Int. Cl.[6] ..... F02D 41/14

[52] U.S. Cl. ..... 123/674

[58] Field of Search ..... 123/674, 675

[56] References Cited

U.S. PATENT DOCUMENTS

| | | | |
|---|---|---|---|
| 4,357,923 | 11/1982 | Hideg | 123/492 |
| 4,391,253 | 7/1983 | Ito | 123/417 |
| 4,481,908 | 11/1984 | Iida | 123/1 A |
| 4,571,683 | 2/1986 | Kobayashi et al. | 123/674 |
| 4,625,698 | 12/1986 | Jamrog | 123/696 |
| 4,655,188 | 4/1987 | Tomisawa et al. | 123/674 |
| 4,945,880 | 8/1990 | Gonze et al. | 123/478 |
| 4,945,881 | 8/1990 | Gonze et al. | 123/486 |
| 4,945,882 | 8/1990 | Brown et al. | 123/695 |
| 4,951,632 | 8/1990 | Yakuwa et al. | 123/688 |
| 4,957,087 | 9/1990 | Ota | 123/479 |
| 4,967,714 | 11/1990 | Inoue | 123/694 |
| 4,982,709 | 1/1991 | Oota | 123/339 |
| 4,986,241 | 1/1991 | Inoue et al. | 123/479 |
| 5,065,726 | 11/1991 | Klenk | 123/674 |
| 5,065,728 | 11/1991 | Nakaniwa | 123/683 |
| 5,178,121 | 1/1993 | Kitajima et al. | 123/689 |
| 5,179,924 | 1/1993 | Manaka | 123/682 |
| 5,179,929 | 1/1993 | Miyashita et al. | 123/688 |

*Primary Examiner*—Andrew M. Dolinar
*Attorney, Agent, or Firm*—Allan J. Lippa; Roger L. May

[57] ABSTRACT

An electronic engine control system incorporates an electronic fuel controller for adaptively altering the amount of fuel delivered to an internal combustion engine. The fuel controller detects the oxygen level contained in the engine's exhaust emissions along with the engine speed, or engine angular velocity, load and other engine operating parameters and varies the fuel delivery in accordance with the detected parameters. The change in fuel delivery is stored in a table contained in a memory. The information stored in the table is utilized by the fuel controller as an addend to a fuel delivery value calculated from the detected operating parameters.

5 Claims, 5 Drawing Sheets

| | | | | | | | | | | | |
|---|---|---|---|---|---|---|---|---|---|---|---|
| .970 | 9 | .500 | .500 | .500 | .500 | .500 | .500 | .500 | .500 | .500 | .500 |
| .850 | 8 | .500 | .500 | .500 | .508 | .512 | .496 | .473 | .496 | .500 | .500 |
| .730 | .7 | .500 | .500 | .496 | .480 | .445 | .473 | .457 | .484 | .508 | .500 |
| .610 | 6 | .500 | .500 | .473 | .473 | .441 | .453 | .441 | .500 | .504 | .500 |
| .490 | 5 | .500 | .484 | .453 | .395 | .414 | .434 | .410 | .453 | .469 | .500 |
| .418 | 4 | .500 | .383 | .398 | .422 | .359 | .434 | .379 | .426 | .500 | .500 |
| .346 | 3 | .500 | .438 | .359 | .434 | .422 | .438 | .387 | .488 | .496 | .500 |
| .274 | 2 | .500 | .500 | .391 | .352 | .352 | .352 | .352 | .500 | .500 | .500 |
| .202 | 1 | .500 | .500 | .500 | .352 | .352 | .352 | .352 | .484 | .500 | .500 |
| .130 | 0 | .500 | .500 | .500 | .500 | .387 | .352 | .422 | .500 | .500 | .500 |
| MAPOPE (load) | table index | 0 | 1 | 2 | 3 | 4 | 5 | 6 | 7 | 8 | 9 |
| | N (engine speed, in RPM) | 688 | 848 | 1174 | 1500 | 2000 | 2500 | 3000 | 3500 | 4000 | 5000 |

Fig. 5

FUEL CONTROLLER WITH AN ADAPTIVE ADDER

FIELD OF THE INVENTION

This invention relates to methods and apparatus for adaptively controlling the fuel delivery to an internal combustion engine.

BACKGROUND OF THE INVENTION

Electronic fuel control systems are increasingly being used in internal combustion engines to precisely meter the amount of fuel required for varying engine requirements. Such systems vary the amount of fuel delivered for combustion in response to multiple system inputs that can include, throttle angle, engine speed, mass airflow rate and the exhaust gas composition produced by combustion of air and fuel.

Electronic fuel control systems operate primarily to maintain the ratio of air and fuel at or near stoichiometry. Electronic fuel control systems operate in a variety of modes depending on engine conditions, such as starting, rapid acceleration, sudden deceleration, and idle. Two primary modes of operation are closed-loop fuel control and open-loop fuel control.

Closed-loop fuel control is utilized when engine output required and exhaust sensor conditions both allow operation to lower harmful emissions. Under closed-loop control, the amount of fuel delivered is primarily determined primarily by an air charge estimate, which is the mass of fresh air captured in a cylinder. This estimate is then modified by a value related to the concentration of oxygen in the exhaust gas. The concentration of oxygen in the exhaust gas is indicative of the fuel-air composition that has been ignited.

In closed-loop operation, the exhaust gas oxygen is sensed by an oxygen sensor. Such an oxygen sensor may be of various types: including a Exhaust Gas Oxygen (EGO) sensor, a Heated Exhaust Gas Oxygen (HEGO) sensor, or Universal Exhaust Gas Oxygen (UEGO) sensor. The electronic fuel control system adjusts the amount of fuel delivered in response to the output of the oxygen sensor. A sensor output indicating a rich air/fuel mixture (an air/fuel mixture with fuel quantity above stoichiometry) will result in a decrease in the amount of fuel being delivered. A sensor output indicating a lean air/fuel mixture (an air/fuel mixture with fuel quantity below stoichiometry) will result in an increase in the amount of fuel being delivered.

The fuel control system maintains adjustment or correction information concerning the amount of fuel required during closed-loop control for different engine speeds (engine angular velocity) and air intake rates. This information varies from engine to engine within a given family or type due to variations in parts, variations in rates of aging of parts, and the conditions under which the vehicle is driven. Consequently, the fuel control system continuously "learns" the different requirements of the engine, and operation under both open-loop and closed-loop control is enhanced.

The information is updated steadily while closed-loop fuel control is employed, and is utilized as a correction term to alter the fuel value generated by the fuel control system. Thus the "learned" information is used to achieve greater accuracy in the amount of fuel delivered to the engine.

Because of fuel control system memory or construction limitations, only limited amount of adjustment information can be stored. Consequently, information corresponding to the precise conditions under which the engine is operating is generally unavailable. In such cases, the information needed is determined by interpolating from the information stored for similar conditions.

Nominally, the relationship between fuelling and mass air flow rate is linear. However, multiplying the generated fuel value by the correction term to determine the fuel delivery rate can lead to errors because an offset in the relationship is affine rather than linear.

SUMMARY OF THE INVENTION

It is a general object of the present invention to increase the performance and minimize the combustion products of an internal combustion engine by accurately controlling the fuel delivery rate at which fuel is supplied to the fuel intake of an internal combustion engine.

In the preferred embodiment of the present invention the amount of fuel supplied to the fuel intake of an internal combustion engine is determined by estimating cylinder air charge into the engine, detecting the exhaust gas composition of the combustion products exhausted by the engine and generating an air/fuel feedback signal from the detected exhaust gas composition. The air/fuel feedback signal is then compared against a predetermined range, and a correction term corresponding to the estimated cylinder air charge is altered if the air/fuel feedback signal is outside of the predetermined range A nominal fuel injection pulsewidth value is generated as a function of the air/fuel feedback signal and the estimated cylinder air charge, and the correction term corresponding to the estimated cylinder air charge is retrieved. The correction term is then added to the nominal fuel injection pulsewidth value to generate a corrected fuel injection pulsewidth value.

An advantage, particularly of certain preferred embodiments, of the invention is that errors in the fuel delivery rate which result from utilizing the linearly interpolated fuel correction term as a multiplier are eliminated by utilizing the correction term as an addend rather than a multiplier. Consequently, emissions are reduced and fuel economy and driveability are enhanced.

This and other features and advantages of the present invention may be better understood by considering the following detailed description of a preferred embodiment of the invention. In the course of this description, reference will frequently be made to the attached drawings.

BRIEF DESCRIPTION OF THE DRAWINGS

FIG. 5 is a table containing data gathered during operation of an engine utilizing a known method of fuel control.

DETAILED DESCRIPTION

Figure 1:
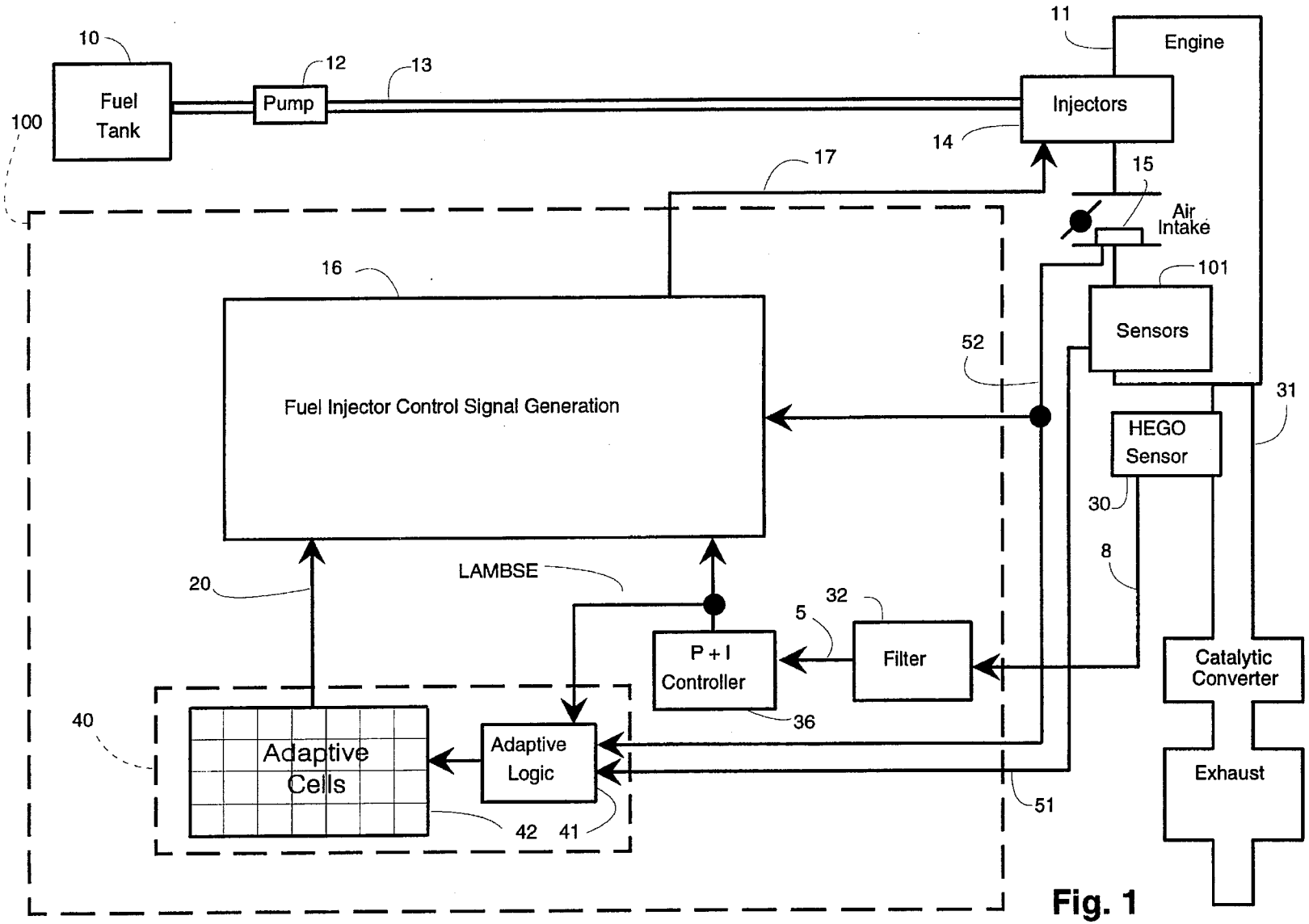
FIG. 1 is a schematic diagram of an internal combustion engine and an electronic engine control system which embodies the invention.

FIG. 1 of the drawings shows a system which embodies the principles of the invention. A fuel pump 12 pumps fuel from a fuel tank 10 through a fuel line 13 to a set of fuel injectors 14 which inject fuel into an internal combustion engine 11. The fuel injectors 14 are of conventional design and are positioned to inject fuel into their associated cylinder in precise quantities. The fuel tank 10 advantageously contains fuels such as, gasoline, methanol, or a combination of fuel types.

A heated exhaust gas oxygen (HEGO) sensor 30, positioned on the exhaust system 31 of the engine 11, detects the oxygen content of the exhaust gas generated by the engine 11, and transmits a representative signal 8 to an Electronic Engine Controller (EEC) 100. Still other sensors, indicated generally at 101, provide additional information about engine performance to the EEC 100, such as crankshaft position, engine angular velocity, throttle position, etc. The information from these sensors is used by the EEC 100 to control engine operation.

A mass air flow detector 15 positioned at the air intake of engine 11 detects the amount of air being supplied to cylinders for combustion. The EEC 100 implements the functions shown, in block diagram form, within the dashed line 100 in FIG. 1. The EEC functions 100 are preferably implemented by one or more microcontrollers, each being comprised of one or more integrated circuits providing a processor, a read-only memory (ROM) which stores the programs executed by the processor and configuration data, peripheral data handling circuits, and a random access read/write scratchpad memory for storing dynamically changing data. These microcontrollers typically include built-in analog-to-digital conversion capabilities useful for translating analog signals from sensors and the like into digitally expressed values, as well as timer/counters for generating timed interrupts.

A microcontroller within the EEC 100 further implements a Proportional +Integral (P+I) controller seen at 36 which responds to a binary HEGO signal 5 to control the amount of fuel delivered by the injectors 14 by supplying an air/fuel signal, LAMBSE, which contains a value representative of an intended mass air/fuel ratio relative to a stoichiometric mass air/fuel ratio, to a further control module 16 which calculates a fuel delivery rate control signal 17, in a manner to be described.

The binary HEGO signal 5 is supplied via a comparator 32 which compares a digitized value of the HEGO signal value 8 to a stored reference value VREF. The comparator 32 generates the binary HEGO signal 5 indicating either a rich or lean air/fuel ratio as detected by the HEGO sensor 31. The P+I controller 36 output is applied concurrently to the fuel injector control signal generation module 16 and to an adaptive logic module 41 which also receives data concerning engine angular velocity and load (mass air charge normalized) via sensor signals 51 and 52 from the engine sensors 101. Sensor lines 51 and 52 contain signals which represent respectively, angular velocity and load indicating values. These values, which in combination indicate an estimated aircharge value into each cylinder of the engine (cylinder air charge) are transmitted to the adaptive logic block 41. The preferred embodiment utilizes engine angular velocity and mass air flow rate to determine an estimate of the cylinder air charge value into the engine. Alternatively, other indicators, such as a combination of manifold pressure and engine angular velocity may also be used to determine an estimate of the cylinder air charge value into the engine.

The P+I controller 36 determines, according to the binary HEGO signal 5, whether the fuel delivery rate at the injectors 14 is to be increased or decreased, depending upon whether the HEGO sensor 30 indicates an oxygen level above or below stoichiometry, respectively.

The adaptive learning module, shown generally within the dashed rectangle 40 as shown in FIG. 1, comprises an adaptive logic unit 41 and an adaptive fuel table 42. The adaptive fuel table 42 is a lookup table in memory comprising a two-dimensional array of learned fuel system correction values, each cell being addressed by first and second values indicating engine angular velocity and load respectively as supplied by signals 51 and 52 respectively. Ideally, if LAMBSE=1.0 and data from an adaptive fuel table 42 in which learning has taken place is used, a stoichiometric air/fuel ratio will result at any speed-load point where adaptive learning has taken place.

Table 42 contains approximately 80 cells indexed by engine angular velocity and load values which contain fuel correction values for those particular speed-load points. Consequently, because of the physical limitations of the memory capacity and speed of the controller 100, only a limited number of values can be stored for the entire range over which the engine may operate. In the instance where the engine is operating at a speed-load point for which no fuel correction value is stored, the controller 100 linearly interpolates the required correction value from the indexed information stored in the table 42. As will be explained, the preferred embodiment advantageously generates the fuel delivery rate control signal (also termed the injector control signal) 17 in a manner which results in an accurate signal regardless of whether the fuel correction value has been directly obtained from the table 42 or has been interpolated from values residing within the table.

Power to the writable memory which contains the adaptive fuel table 42 is maintained even when the engine is turned off so as to maintain the information stored in the memory. Termed a "Keep Alive Memory" (KAM), this section of the memory is continuously powered by the vehicle battery, even when the ignition key is turned off, and allows values which describe past engine performance to be "learned" and then used later to better control the subsequent operation of the engine.

The adaptive logic unit 41 controls the functions of the adaptive learning module 40. The cell value that is read from table 42 varies between 0.0 and 1.0 and is increased, by the adaptive logic module 41, by the offset value 0.5 to generate the fuel correction term $k_{compensation}$, seen at 20 in FIG. 1, supplied to the fuel injector control signal generator 16. Thus the fuel correction term $k_{compensation}$ 20 will range from 0.5 to 1.5.

The adaptive learning module 40 operates under the control of the adaptive logic unit 41 to implement an adaptive learning strategy which enhances the engine performance. Fuel injected systems may exhibit vehicle to vehicle steady state air/fuel ratio errors due to normal variability in fuel system components. The adaptive learning module alleviates this problem by memorizing the characteristics of the individual fuel system being used. This memorized information is used to predict what the system will do based on past experience. The ability to predict fuel system behavior improves both open loop and closed loop fuel control. As an example, the memorized information can be used on cold starts to achieve better open loop fuel control before the HEGO sensor reaches operating temperature. The chief benefit of the adaptive fuel strategy however, is to reduce the effects of product variability in the field.

The adaptive learning module 40 operates as follows: The output of the P+I controller 36 (LAMBSE) is checked against upper and lower calibratable limits. The adaptive learning module 40 will determine LAMBSE to be outside of a calibratable range if LAMBSE is greater than an upper calibratable limit or less than a lower calibratable limit. This limit is specific to each type of engine in which the control system is installed and is typically about 1%. Thus, if LAMBSE exceeds the limit, the cell in the adaptive table 42 corresponding to the angular velocity and load at which the engine is currently operating is incremented. If LAMBSE is below the limit, the cell in the adaptive table 42 corresponding to the angular velocity and load at which the engine is currently operating is decremented to increase fuel delivery at that load and engine angular velocity. Thus, each cell value is able to reflect an ongoing learned value representing the particularities of the specific engine in which the table 42 is installed.

The steps taken by the EEC 100 in the generation of the injector control signal 17 may be summarized as follows: First, engine operating parameters such as system voltage, engine angular velocity, airflow rate into the intake manifold (load), and the HEGO sensor output are measured. The output of the comparator 32, which generates the binary HEGO signal 5 from the HEGO sensor output 8, is utilized by the P+I controller 36 to generate the air/fuel signal LAMBSE. Adaptive learning module 40 utilizes LAMBSE, along with the detected engine angular velocity and load to generate the fuel correction term $k_{compensation}$ 20. The fuel injector control signal generation module 16 generates a nominal fuel injection pulsewidth value as a function of the air/fuel feedback signal, the engine angular velocity, and load; and adds the correction term $k_{compensation}$ to the nominal fuel injection pulsewidth value. Finally, the fuel injector control signal generation module adds an offset, which is a function of the detected system voltage, to the corrected nominal fuel injection pulsewidth value to generate the injector control signal 17.

As mentioned above, the preferred embodiment advantageously avoids errors which occur in utilizing a linearly interpolated fuel correction value together with a multiplicative term. A known method generates a fuel injector control signal according to the following relationship:

$$t_{injection} = k_{multiplier}\frac{\dot{m}_{air}\cdot k_{compensation}}{AFR\cdot\lambda_{intended}} + k_{adder} \tag{1}$$

where $t_{injection}$ is the fuel injection pulsewidth signal;

$k_{multiplier}$ is all the terms that multiply fuel injection pulsewidth, this term is formed from the reciprocal of engine angular velocity and various constants;

$\dot{m}_{air}$ is the mass flow rate of air passing through said air induction means;

$k_{compensation}$ is a term used to modify the nominal calibration;

AFR is the nominal stoichiometric air-fuel ratio for typical fuels (e.g. 14.64 for gasoline);

$\lambda_{intended}$ is the intended relative air-fuel ratio (LAMBSE); and $k_{adder}$ is formed from the terms that add to fuel injection pulsewidth.

The relationship shown above in equation (1) is accurately corrected by values which are stored in the table 42 at the exact speed-load points of the table. However, for speed-load points for which the correction value $k_{compensation}$ is linearly interpolated, the above relationship will result in an error.

In a preferred embodiment, the fuel injector control signal generator 16 generates the fuel delivery rate control signal 17 according to the following relationship:

$$t_{injection} = k_{multiplier}\left[\frac{\dot{m}_{air}}{AFR\cdot\lambda_{intended}} + k_{compensation}\right] + k_{adder} \tag{2}$$

where the variables are as those given for equation (1). The above relationship advantageously provides an accurate fuel injector control signal 17 when the fuel correction value $k_{compensation}$ is obtained directly from the table at an exact speed-load point, or is linearly interpolated from values stored in the table 42 for speed-load points intermediate between table entries. As will be shown below, known methods of fuel control are unable to accurately control fuel delivery when the error, here represented by the value $k_{compensation}$, deviates from the actual required fuel injection value by an affine function.

As will be appreciated by those skilled in the art, $k_{compensation}$ is a negated value of the error. A linear function is a straight line passing through the origin. An affine function is a straight line not necessarily passing through the origin. Thus a linear function can be represented by an equation of the form y=mx, whereas an affine function is represented by an equation of the form y=mx+b, where m is the slope and b is an offset along the y axis from the origin. When stored correction values are used at speed-load points that match exactly those of the cell boundary, known methods of determining a fuel injector value yield a correct result. However, in the case of a known fuel system, when interpolated values are used an error results for speed-load values not exactly aligned with cell boundaries.

For purposes of illustration, let $k_{multiplier}=1$, $k_{adder}=0$, $\lambda_{intended}=1$, and AFR=1. In order to simplify the following illustration, units for each of the terms are not utilized. Then equation (1) becomes:

$$t_{injection}=\dot{m}_{air}\cdot k_{compensation} \tag{3}$$

The nominal function (i.e. $k_{compensation}=1$) becomes:

$$t_{injection}=\dot{m}_{air} \tag{4}$$

If the actual (i.e. something other than nominal) fuelling system performance is:

$$t_{injection}=0.75\dot{m}_{air}-0.75 \tag{5}$$

then, given two values of $\dot{m}_{air}$, 2 and 4, taken from a table, the known system will learn compensation values of:

$$k_{compensation} = \frac{t_{injection}}{\dot{m}_{air}} \tag{6}$$

$$k_{compensation}|_{\dot{m}_{air}=2} = \frac{0.75}{2} = \frac{3}{8} \tag{7}$$

and $$k_{compensation}|_{\dot{m}_{air}=4} = \frac{2.25}{4} = \frac{9}{16} \tag{8}$$

Interpolating to find $k_{compensation}$ at $\dot{m}_{air} = 3$, $$k_{compensation} = \frac{7.5}{16} \tag{9}$$

the resulting injection is:

$$t_{injection} = \dot{m}_{air}k_{compensation} = 3\cdot\frac{7.5}{16} = 1.40625 \tag{10}$$

Given the actual fuelling system performance to be $t_{injection}=0.75\dot{m}-0.75$, the desired $t_{injection}$ value is 1.5, rather than 1.40625, which is the value generated by the known method of fuel control.

The embodiment of the present invention, as will be shown below, provides an accurate fuel injector control signal 17 when $k_{compensation}$ is interpolated. For purposes of illustration, as before, let $k_{multiptier}=1$, $k_{adder}=0$, $\lambda_{intended}=1$, AFR=1, and as above, ignore units. Then equation (2) becomes:

$$t_{injection}=\dot{m}_{air}+k_{compensation} \tag{11}$$

The nominal function becomes:

$$t_{injection}=\dot{m}_{air} \tag{12}$$

As before, let the actual fuelling system performance be $t_{injection}=0.75\dot{m}_{air}-0.75$. Given, two values of $\dot{m}_{air}$,2 and 4, as before, the system would learn compensation values of:

$$k_{compensation}=t_{injection}-\dot{m}_{air} \tag{13}$$

$$k_{compensation}|_{\dot{m}_{air}=2}=0.75-2=-1.25 \tag{14}$$

at $\dot{m}_{air}=2$; and $$k_{compensation}|_{\dot{m}_{air}=4}=2.25-4=-1.75 \tag{15}$$

at $\dot{m}_{air}=4$.

Interpolating to find $k_{compensation}$ at $\dot{m}_{air}=3$, $k_{compensation}=-1.50$, and the resulting injection is:

$$t_{injection}=\dot{m}_{air}+k_{compensation}=3+(-1.50)=1.50 \tag{16}$$

Thus the preferred embodiment provides an exact fuel injector control signal. $t_{injection}$, using an interpolated fuel correction signal $k_{compensation}$, whereas the method shown in equation (1) generates an inaccurate fuel injector control signal.

Figure 3A:
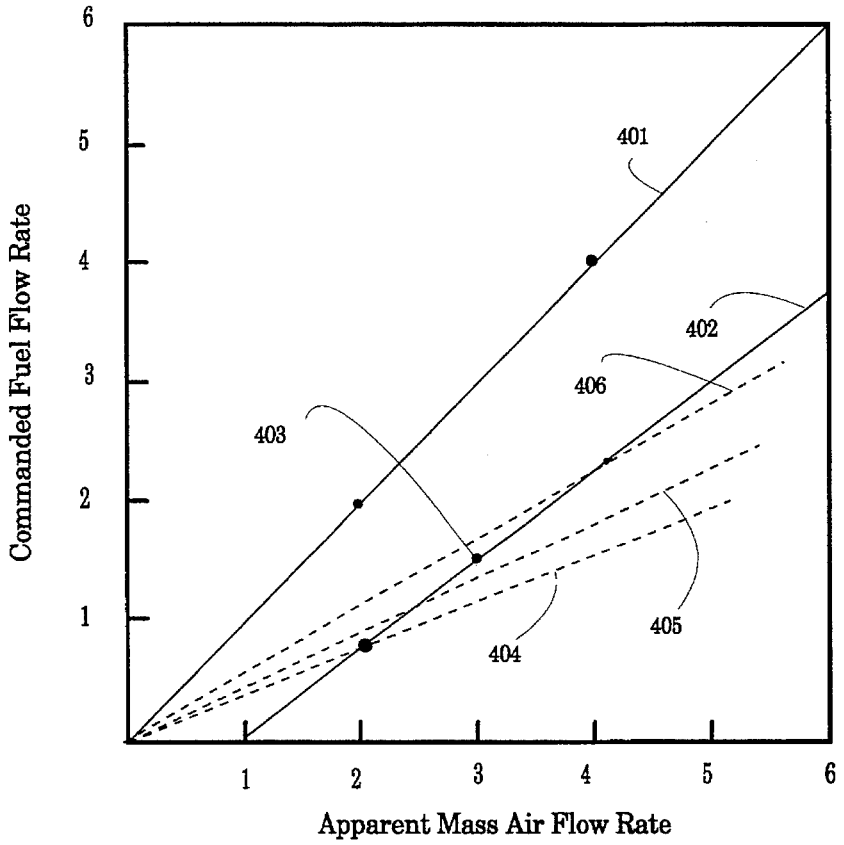
FIGS. 3(*a*), 3(*b*), 4(*a*) and 4(*b*) are graphs showing the performance, for various fuel flow and air flow rates, for a known fuel control system and the preferred embodiment of the invention.
Figure 3B:
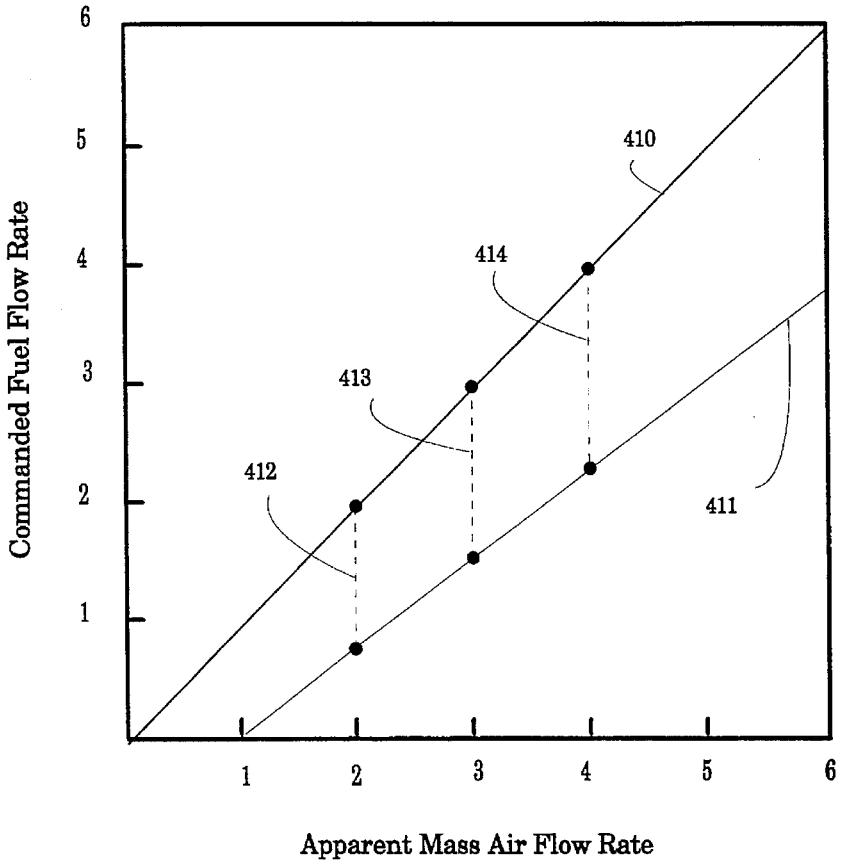

FIGS. 3(*a*) and 3(*b*) illustrate graphically the difference between the method shown in equation (1) which uses the fuel correction signal, $k_{compensation}$ as a multiplier, and the embodiment of the present invention which uses the fuel correction signal as an adder. In FIG. 3(*a*), the effects of using $k_{compensation}$ as a multiplier are illustrated. The vertical axis represents the commanded fuel flow rate and the horizontal axis represents the apparent mass air flow rate. The nominal relation between these values is shown at 401 and the actual relation is shown at 402. The dotted lines 404, 405 and 406 represent the actual relations generated by the known method discussed above for air flow rates of respectively, two, three and four; the air flow rate of three being interpolated. For an apparent mass air flow rate of three, where the fuel correction value is generated by interpolation from stored values, the commanded fuel flow rate can be seen, at 403, to fall below the actual relation.

FIG. 3(*b*) illustrates the effects of using $k_{compensation}$ as an adder, as in the preferred embodiment. In FIG. 3(*b*), the nominal calibration is shown at 410 and the actual calibration is shown at 411. The dotted lines 412, 413 and 414 show respectively, the difference between the nominal calibration and actual calibration for the air flow rates of two, three and four; the air flow rate of three being interpolated as in FIG. 3(*a*). In FIG. 3(*b*), the commanded fuel flow rate can be seen to equal the actual relation for an apparent mass air flow rate of three, where the fuel correction value is generated by interpolation from stored values.

While the above illustration showed, for clarity, interpolation in one variable, interpolation in the preferred embodiment of the invention is performed in two variables, in a manner similar to the following method of interpolation in a single variable x.

To get $y_w$ from $x_w$ given $(x_1, y_1)$ and $(x_2, y_2)$ via linear interpolation:

$$y_w = y_1 + \alpha \cdot \Delta y, \text{ where, } \alpha = \frac{x_w - x_1}{x_2 - x_1} \tag{17}$$

$$\Delta y = y_2 - y_1 \tag{18}$$

Substituting the following implementation values for the variables in the above equation:

$$y_w = y_1 + \frac{x_w - x_1}{x_2 - x_1} \cdot (y_2 - y_1) \tag{19}$$

| | | |
|---|---|---|
| $KAMREF_j$ | for | $y_1$, |
| $KAMREF_{j+1}$ | for | $y_2$, |
| $KAMREF$ | for | $y_w$, |
| $AM_j$ | for | $x_1$, |
| $AM_{j+1}$ | for | $x_2$, |
| $AM$ | for | $x_w$; |

yields the following method of interpolation utilized in the preferred embodiment:

$$KAMREF = KAMREF_j + \frac{AM - AM_j}{AM_{j+1} - AM_j}(KAMREF_{j+1} - KAMREF_j). \tag{20}$$

As the following will show, when the above method of interpolation is inserted into the known method of fuel control as shown in equation (1), a parabolic relationship results. Begin by substituting the following implementation values for those in equation (1), PW for $t_{injection}$, AM for $\dot{m}_{air}$, KAMREF for $k_{compensation}$, and LAMBSE for $\lambda_{intended}$ yields the following equation:

$$PW = k_{multiplier}\frac{AM \cdot KAMREF}{AFR \cdot LAMBSE} + k_{adder}. \tag{21}$$

Substituting the method of interpolation expressed in equation (20) yields the following equation for generating the fuel injection pulsewidth:

$$PW = k_{multiplier}\frac{AM \cdot \left( KAMREF_j + \frac{AM - AM_j}{AM_{j+1} - AM_j} \cdot (KAMREF_{j+1} - KAMREF_j) \right)}{AFR \cdot LAMBSE} + k_{adder} \tag{22}$$

Figure 4A:
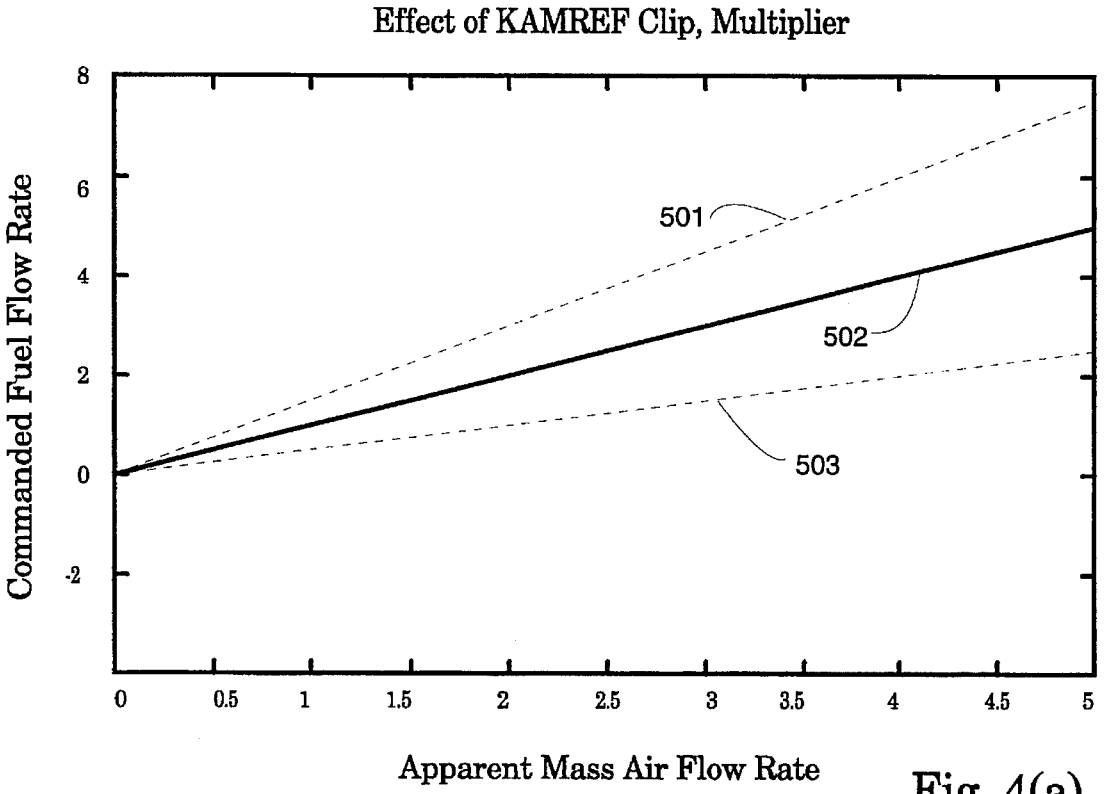
Figure 4B:
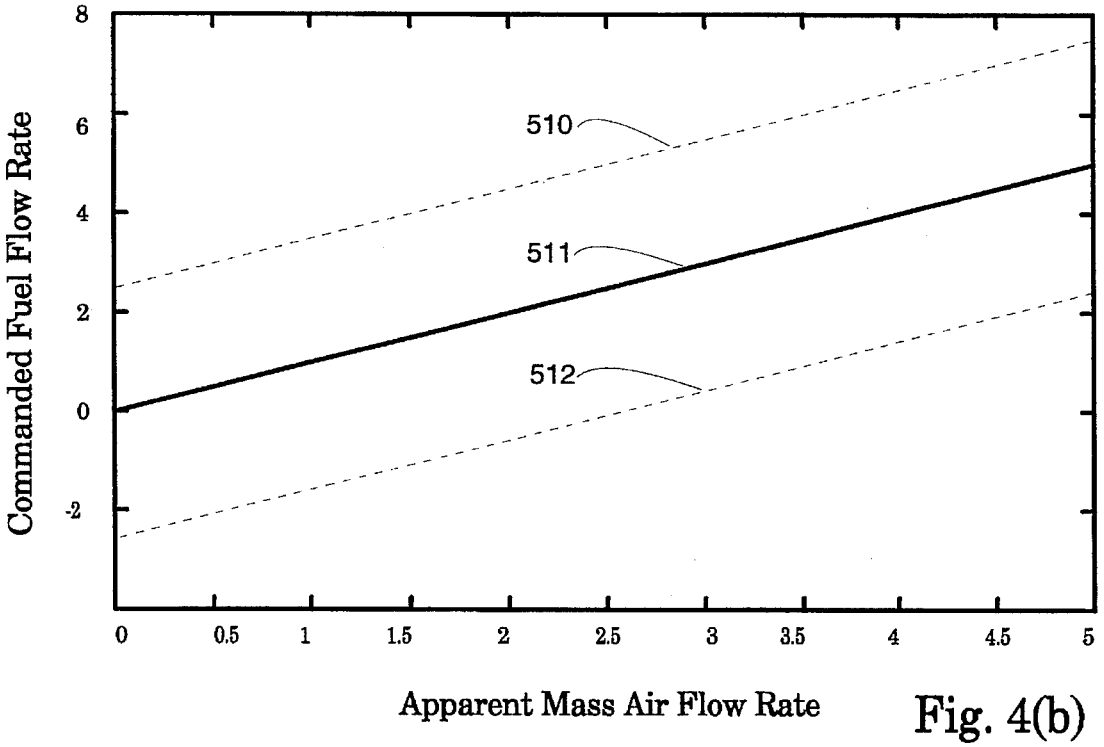

The value KAMREF is linearly interpolated from the table 42 shown in FIG. 1. and then clipped such that 0.5<KAMREF<1.5. The range of adaptation as a result of such clipping is illustrated in FIG. 4(*a*). Line 502 shows the nominal fuel flow rate, and dotted lines 501 and 503 show respectively, maximum and minimum fuel flow rates allowed by the clipped value of KAMREF. Due to the dynamic range of the engine airflow and fuel injection pulsewidth, the zero range of authority seen at the left hand side of the graph never actually occurs.

By inspection, it can be seen that the relationship expressed in equation (22), by way of the AM term (factored in the equation above), is parabolic. Consequently, interpolating KAMREF between the points $AM_j$ to $AM_{j+1}$ results in a parabolic segment where the curvature of the parabola is concave up or down depending on the sign of the change of KAMREF across an interval. This means that, except at the exact points themselves, the interpolated points are always either above or below a best fit straight line.

The preferred embodiment calculates KAMREF by a method of linear interpolation as shown in equation (20). Substituting, into equation (2) the following implementation values: PW for $t_{injection}$, AM for $\dot{m}_{air}$, LAMBSE for $\lambda_{intended}$, and KAMREF for $k_{compensation}$, transforms equation (2) into the following:

$$PW = k_{multiplier}\left(\frac{AM}{AFR \cdot LAMBSE} + \frac{AM_{maximum}(KAMREF - 1)}{AFR \cdot LAMBSE}\right) + k_{adder}. \tag{23}$$

In the above equation, $AM_{maximum}$ has been inserted to provide a scale factor for KAMREF to control the allowed maximum effect of adaptation while KAMREF has been centered about a value of one. As will be appreciated by those skilled in the art, this advantageously allows KAMREF to be stored as a fixed point binary number between zero and one, to which a value of 0.5 is added, to maximize information storage resolution.

Substituting the method of interpolation expressed in equation (20) yields the following method for generating the fuel injection pulsewidth:

$$PW = k_{multiplier}\left(\frac{AM}{AFR \cdot LAMBSE} + \frac{AM_{maximum}\left(KAMREF_j + \frac{AM - AM_j}{AM_{j+1} - AM_j} \cdot (KAMREF_{j+1} - KAMREF_j) - 1\right)}{AFR \cdot LAMBSE}\right) + k_{adder}. \tag{24}$$

By inspection, this relationship can be seen to be linear, unlike the relationship expressed in equation (22). The value KAMREF is linearly interpolated from the table 42 shown in FIG. 1, and then clipped such that 0.5<KAMREF<1.5. The range of adaptation as a result of such clipping is illustrated in FIG. 4(*b*). Line 511 shows the nominal fuel flow rate and dotted lines 510 and 512 show, respectively, the maximum and minimum fuel flow rates allowed by the clipped value of KAMREF.

The benefits of the present invention can be further demonstrated by comparing the method of the present invention with a known method using actual data extracted from a vehicle. The table in FIG. 5 contains correction values extracted from an actual vehicle, which uses the method expressed in equation (22), for different engine loads and speeds. Engine load, given as the intake manifold pressure/exhaust pressure, is indexed along the vertical direction and engine speed, or engine angular velocity, given in revolutions per minute, is indexed along the horizontal direction.

To obtain correction values which would be contained in an engine control system utilizing the invention of the preferred embodiment, points were chosen where the two methods would yield equivalent results, i.e. where interpolation is not necessary. At these points, the correction value $KAMREF_{proposed}$ was calculated from the actual correction value $KAMREF_{present}$ contained in the extracted table.

To simplify the following comparison between a known method and the method of the preferred embodiment, only interpolation along the load axis will be presented. Moreover, the following values will be assumed:

$$\begin{aligned} k_{multiplier} &= 1, \\ k_{adder} &= 0, \\ AFR &= 1, \text{ and} \\ LAMBSE &= 1. \end{aligned}$$

From the above table, choosing an engine speed in the table—1500 rpm, and interpolating in the load direction, e.g. 0.3, and inserting into equation (21) above, yields the following:

$$PW = k_{multiplier}\frac{AM \cdot KAMREF}{AFR \cdot LAMBSE} + k_{adder} \tag{25}$$

which for the values assumed for $k_{multiplier}$, $k_{adder}$, AFR and LAMBSE becomes:

$$PW_{relative} = AM \cdot KAMREF \tag{26}$$

Inserting the assumed values for engine speed and load into equation (20) to calculate KAMREF:

$$KAMREF|_{MAPOPE=0.3,N=1500} = 0.882 \tag{27}$$

Then inserting values for KAMREF and AM into equation (26), yields the following fuel injection pulsewidth:

$$PW_{relative} = 0.3 - 0.882 = 0.265. \tag{28}$$

To generate a fuel injection pulsewidth for the method of the preferred embodiment, the same values for $k_{multiplier}$, $k_{adder}$, AFR and LAMBSE, as given above are assumed. Thus the relationship expressed in equation (23) reduces to the following:

$$PW_{relative} = AM + AM_{maximum}(KAMREF - 1) \tag{29}$$

As mentioned previously, because KAMREF is used in a different equation struction in the method of the preferred embodiment, a value for $KAMREF_{proposed}$ must be generated from the KAMREF value present in the table shown in FIG. 6. This can be done by equating expressions (26) and (29):

$$AM \cdot KAMREF_{present} = AM + AM_{maximum}(KAMREF_{proposed} - 1), \tag{30}$$

rearranging to solve for $KAMREF_{proposed}$:

$$KAMREF_{proposed} = \frac{AM \cdot (KAMREF_{present} - 1)}{AM_{maximum}} + 1 \tag{31}$$

Arbitrarily assign $AM_{maximum}$ to equal 0.97, which corresponds to the highest load shown in FIG. 5.

$$KAMREF_{present}|_{MAPOPE=0.274,N=1500} = 0.859 \rightarrow \quad (32)$$

$$KAMREF_{proposed}|_{MAPOPE=0.274,N=1500} = 0.960$$

$$KAMREF_{present}|_{MAPOPE=0.346,N=1500} = 0.934 \rightarrow \quad (33)$$

$$KAMREF_{proposed}|_{MAPOPE=0.346,N=1500} = 0.976$$

Using equation (20) and the above derived values to interpolate a value for $KAMREF_{proposed}$ at the intermediate load point yields:

$$KAMREF_{proposed}|_{MAPOPE=0.3,N=1500} = \quad (34)$$

$$0.960 + \frac{0.3 - 0.274}{0.346 - 0.274} \cdot (0.976 - 0.960) = 0.966$$

and finally:

$$PW_{relative} = 0.3 + 0.97(0.966 - 1) = 0.267 \quad (35)$$

As can be seen from the above calculations, for the particular speed-load point chosen, the method of the preferred embodiment differs from the known method by 0.75% (0.265/0.267). This difference is sufficient to cause the HEGO sensor 30 of FIG. 1 to switch, causing erroneous catalyst and controller operation.

Figure 2:
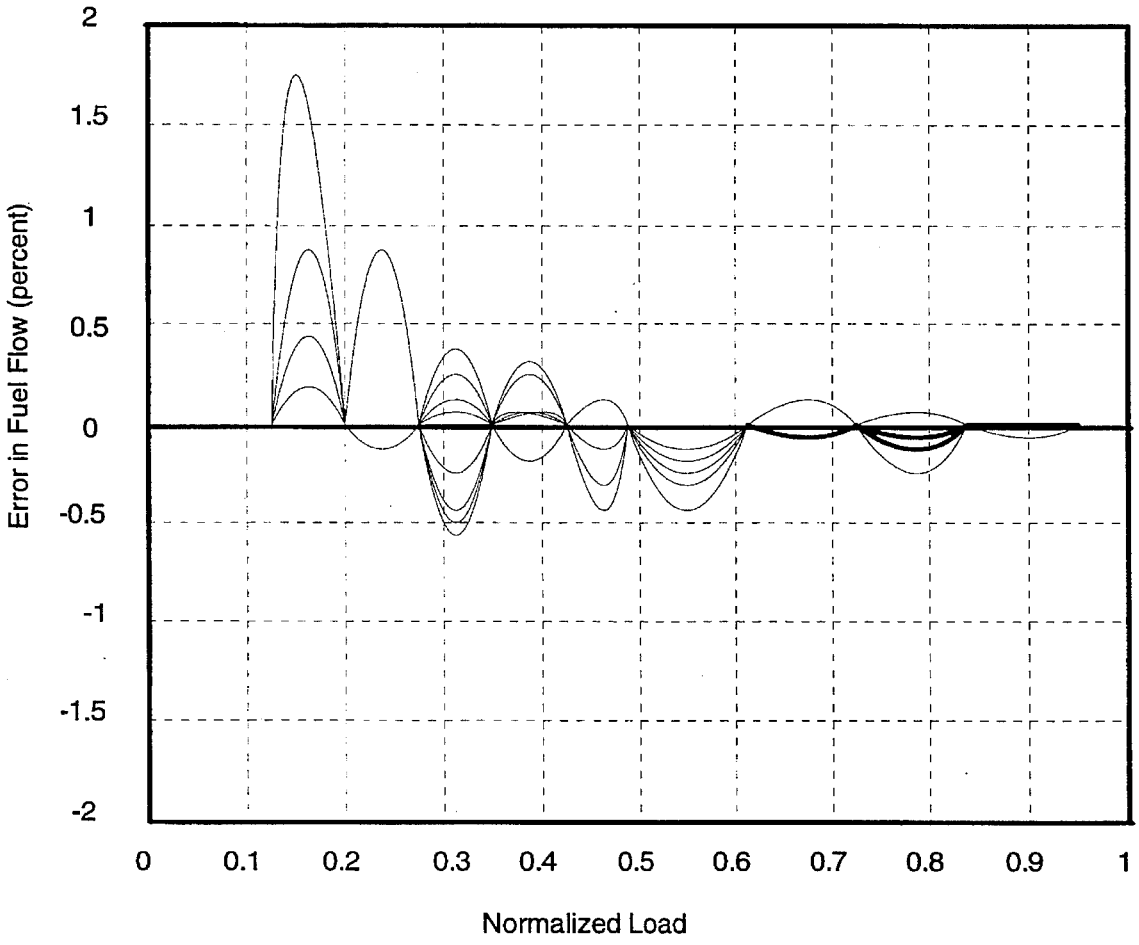
FIG. 2 is a graph showing the error in fuel flow for various normalized loads of a known fuel control system.

FIG. 2 illustrates the error in fuel flow for various normalized loads of a known fuel control system. The horizontal axis shows normalized load and the vertical axis shows the percentage difference in fuel flow between the known method discussed above and the ideal fuel flow. Data was collected at 688, 848, 1174, 1500, 2000, 2500, 3000, 3500, 4000, and 5000 engine revolutions per minute. This data can be seen in the table of FIG. 6. The parabolic "scallops" caused by use of the known method can be seen to be larger at lower airflows, with the maximum relative error being 1.7%, which is sufficient to cause the injection of an amount of fuel which differs sufficiently to cause an undesired switch in the HEGO sensor 30 of FIG. 1. This is expected because where an offset error exists in fuel metering or air mass charge estimation, the ratio of fuel to air is most affected at low airflows.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. The method of controlling the amount of fuel supplied to the fuel intake of an internal combustion engine, the method comprising, in combination, the steps of:

during a closed loop method of operation, when the engine is subjected to a load greater than an idling load, detecting the angular velocity of said engine and the air mass flow rate into said engine, detecting the exhaust gas composition of the combustion products exhausted by said engine, generating an air/fuel signal from said detected exhaust gas composition, comparing said air/fuel signal against a predetermined range, altering a correction term corresponding to said detected angular velocity and said air mass flow rate if said air/fuel signal is outside of said predetermined range, and storing said correction term in a memory which contains a plurality of correction terms indexed by angular velocity and mass air flow rate;

during at least said closed loop method of operation, when the engine is subjected to a load greater than an idling load, generating a nominal fuel injection pulsewidth as a function of said air/fuel signal, said detected angular velocity and said mass flow rate of air, generating a fuel correction factor corresponding to said detected angular velocity and said mass air flow rate, by retrieving one of said correction terms which corresponds to said angular velocity and mass air flow rate, and if a correction term corresponding to said angular velocity and mass air flow rate is not stored in said memory, then generating said fuel correction factor by interpolating said fuel correction factor from a correction term stored in the memory, said generated fuel correction factor related to said nominal fuel injection pulsewidth by an affine relationship; and generating a fuel injection value which controls the amount of fuel supplied to the fuel intake of the engine by adding said correction factor to said nominal fuel injection pulsewidth.

2. An air/fuel control system for an internal combustion engine which comprises, in combination:

means for detecting the exhaust gas composition of the combustion products exhausted by said engine;

means for detecting the angular velocity of said engine and the air mass flow rate into said engine;

means for generating an air/fuel signal from said detected exhaust gas composition;

means, operable when the air mass flow rate into the engine indicates a load greater than a load at engine idle, comprising means for comparing said air/fuel signal against a predetermined range, and altering a correction term corresponding to said detected angular velocity and air mass flow rate if said air/fuel signal is outside of said predetermined range;

means for generating a nominal fuel injection pulsewidth value as a function of said air/fuel signal, said detected angular velocity and said air mass flow rate;

means for retrieving a correction term corresponding to said detected angular velocity and said air mass flow rate and related to said nominal fuel injection pulsewidth by an affine relationship;

means for interpolating a correction term from a plurality of stored correction terms; and means for generating a fuel injection value which controls the amount of fuel injected into an intake of the engine by adding said retrieved or interpolated correction term to said nominal fuel injection pulsewidth value.

3. An electronic engine controller for controlling the amount of fuel delivered to combustion chambers of an internal combustion engine comprising, in combination:

means for generating an exhaust gas composition signal indicative of the concentration of exhaust gas produced by said engine;

means for generating an engine speed signal indicative of the angular velocity of the engine;

means for generating a cylinder air charge value;

a p-i controller, responsive to said exhaust gas composition signal, for generating an air/fuel signal which is indicative of a quantity by which the fuel delivery rate is to be changed;

an adaptive learning module, operable when said engine controller is in at least a closed loop form of control with an engine load which is greater than an idling load, responsive to said air/fuel signal, to said engine speed signal, and to said air charge value, comprising storage means for storing, as a function of said engine speed signal and air charge value, a plurality of adaptive correction values; and learning means for selectively altering the adaptive correction values by comparing said air/fuel signal to an upper and a lower calibratable limit, and altering an adaptive correction value corresponding to said engine speed signal and to said air charge value if said air/fuel signal is below said lower calibratable limit or above said upper calibratable limit;

fuel injector control signal generation means, operable when said engine controller is in at least a closed loop form of control with an engine load which is greater than an idling load, comprising means for generating a nominal fuel injection pulsewidth value as a function of the air/fuel signal, the engine speed signal and the air charge value;

means for retrieving an adaptive correction value, which corresponds to said engine speed signal and to said air charge value and for interpolating an adaptive correction value from adaptive correction values stored in said storage means if said storage means does not contain an adaptive correction value which corresponds to said engine speed signal and to said air charge value;

means for adding said adaptive correction value to said nominal fuel injection pulsewidth value, said adaptive correction value and said nominal fuel injection pulsewidth value differing by an affine relationship; and means for generating a fuel injection pulsewidth signal which controls the fuel delivery rate into the intake of the engine as a function of the sum of said adaptive correction value and said nominal fuel injection pulsewidth value.

4. The electronic engine controller as set forth in claim 3 wherein the means for generating a cylinder air charge value comprises:

means for detecting the air mass flow rate into said engine; and means for estimating said cylinder air charge value as a function of said detected air mass flow rate and said engine angular velocity.

5. The invention as set forth in claim 3 wherein the means for generating a fuel injection pulsewidth signal which controls the fuel delivery rate into the intake of the engine generates the fuel injection pulsewidth signal in accordance with the relationship:

$$t_{injection} = k_{multiplier}\left[\frac{\dot{m}_{air}}{AFR * \lambda_{intended}} + k_{compensation}\right] + k_{adder}$$

where, $t_{injection}$ corresponds to the fuel injection pulsewidth signal;

$k_{multiplier}$ is a multiplicative term which is a function of the engine speed signal and at least one predetermined constant;

$m_{air}$ corresponds to the air charge value;

$k_{compensation}$ corresponds to the adaptive correction value;

AFR corresponds to a stoichiometric air-fuel ratio;

$\lambda_{intended}$ corresponds to a desired air-fuel ratio; and $k_{adder}$ is a additive term which is a function of at least a predetermined value.

* * * * *